US007100379B2

(12) United States Patent
Son et al.

(10) Patent No.: US 7,100,379 B2
(45) Date of Patent: Sep. 5, 2006

(54) WATER SUPPLY CONTROL APPARATUS AND METHOD FOR ICE MAKER

(75) Inventors: Seok Jun Son, Gwangiu (KR); Yong Pil Park, Suwon-si (KR); Seong Ki Jeong, Yongin-si (KR); Song Yik Lee, Gwangiu (KR); Joon-Dong Ji, Suwon (KR); Yong Jun Park, Seongnam-Si (KR); Seong Il Jeong, Jeongeup-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/900,395

(22) Filed: Jul. 28, 2004

(65) Prior Publication Data

US 2005/0097903 A1 May 12, 2005

(30) Foreign Application Priority Data

Aug. 14, 2003 (KR) ..... 10-2003-0056385
Jul. 22, 2004 (KR) ..... 10-2004-0057269

(51) Int. Cl.
*F25C 1/04* (2006.01)

(52) U.S. Cl. ..... 62/74; 62/233

(58) Field of Classification Search ..... 62/74, 62/135, 137, 233, 347
See application file for complete search history.

(56) References Cited

U.S. PATENT DOCUMENTS 4,787,216 A * 11/1988 Chesnut et al. ..... 62/347
4,872,317 A * 10/1989 Reed ..... 62/135
4,987,746 A * 1/1991 Roberts ..... 62/137
5,027,610 A * 7/1991 Hara ..... 62/135
6,092,374 A * 7/2000 Kang et al. ..... 62/74
6,705,091 B1 * 3/2004 Kim et al. ..... 62/74

* cited by examiner

*Primary Examiner*—William E. Tapolcai
(74) *Attorney, Agent, or Firm*—Staas & Halsey LLP

(57) ABSTRACT

A water supply control apparatus and method for an ice maker, in which an amount of supplied water is controlled so as to supply an accurate amount of the water to an ice tray. The method includes the steps of (a) supplying water to an ice tray for a predetermined time; (b) determining whether or not a proper amount of water has been supplied to the ice tray after the predetermined time has elapsed; and (c) resetting the predetermined time based on predetermined water supply data, in case that it is determined that the proper amount of water has not supplied to the ice tray.

13 Claims, 6 Drawing Sheets

WATER SUPPLY CONTROL APPARATUS AND METHOD FOR ICE MAKER

CROSS-REFERENCE TO RELATED APPLICATION

This application claims the benefit of Korean Patent Application No. 2003-56385, filed on Aug. 14, 2003 and Korean Patent Application No. 2004-57269, filed on Jul. 22, 2004 in the Korean Intellectual Property Office, the disclosure of which is incorporated herein by reference.

BACKGROUND OF THE INVENTION

1. Field of the Invention

The present invention relates to a water supply control apparatus and method for an ice maker, and more particularly to a water supply control apparatus and method for an ice maker, in which additional water supply, after initial water supply is completed, is performed based on the initially supplied amount of water, or an initial water supply time is reset.

2. Description of the Related Art

Generally, a refrigerator comprises a main body including a freezing chamber and a refrigerating chamber, and a compressor for compressing a refrigerant and a heat exchanger for generating cool air, which are installed at the rear portion of the main body. The cool air generated from the heat exchanger is supplied to the inside of the freezing chamber or the refrigerating chamber by means of a fan, and is circulated in the freezing chamber or the refrigerating chamber. Then, the heated air obtained by the circulation again passes through the heat exchanger, and the obtained cool air is again supplied to the inside of the freezing chamber or the refrigerating chamber. The above repetitive circulation of the cool air keeps foods stored in the freezing chamber or the refrigerating chamber fresh.

In an ice-making device installed in the freezing chamber of the above refrigerator, water is automatically supplied to an ice tray, and an ice-making state of the ice tray is checked. When it is determined that the ice-making is completed, the obtained ice cubes are automatically separated from the ice tray, and are then stored in an ice storage container. The ice-making device produces ice cubes without separate user' manipulation, thereby being popular among consumers now.

Now, a conventional water supply control apparatus for an ice maker will be described with reference to FIG. 1. As shown in FIG. 1, the conventional water supply control apparatus comprises a water supply pipe 3 connected to a water supply source 1 for supplying water to an ice tray 6, a water supply valve 4 installed at a designated point in the water supply pipe 3 for adjusting the amount of water flowing in the water supply pipe 3, and a rotary hydraulic turbine 5 installed between the water supply valve 4 and an outlet of the water supply pipe 3 and rotated by water pressure. The conventional water supply control apparatus further comprises a purification filter 2 installed at another designated point in the water supply pipe 3 for purifying the water flowing the water supply pipe 3, and the ice tray 6 for receiving water supplied from the water supply pipe 3 and generating ice cubes.

Hereinafter, an operation of the above-described conventional water supply control apparatus will be described. First, when instructions to generate ice are inputted to the water supply control apparatus, a controller (not shown) opens the water supply valve 4. When the water supply valve 4 is opened, water is supplied to the water supply control apparatus through the water supply pipe 3 connected to the water supply source 1. Here, the water flowing along the water supply pipe 3 is purified by the purification filter 2, and is then supplied to the ice tray 6.

During the water supply, the controller determines whether or not a predetermined water supply time has elapsed, and closes the water supply valve 4 when it is determined that the predetermined water supply time has elapsed. Thereby, a process of supplying water to the ice tray 6 is completed.

The above-described conventional water supply control apparatus and method for an ice maker simply control the water to be supplied to the ice tray during the predetermined time, and do not consider variation in the water pressure or other factors, thus causing a difficulty of supplying an accurate amount of water to the ice try.

SUMMARY OF THE INVENTION

Therefore, an aspect of the invention is to provide a water supply control apparatus and method for an ice maker, in which water supply is controlled so that an accurate amount of the water is supplied to an ice tray.

In accordance with one aspect, the present invention provides a water supply control method for an ice maker comprising the steps of: (a) supplying water to an ice tray for a predetermined time; (b) determining whether or not a proper amount of water has been supplied to the ice tray after the predetermined time has elapsed; and (c) resetting the predetermined time based on predetermined water supply data, in case that it is determined that the proper amount of water has not supplied to the ice tray.

In step (c), water may be additionally supplied to the ice tray together with resetting the predetermined time based on the predetermined water supply data, in case that it is determined that less than the proper amount of water has been supplied to the ice tray.

The step (b) may include the sub-steps of: (b-1) supplying water to the ice tray for a first predetermined time, and sensing variation in the temperature of the ice tray; (b-2) sensing time taken to vary the temperature of the ice tray by a predetermined first temperature variation; and (b-3) determining that the proper amount of water has been supplied to the ice tray in case that the sensed time is the same as a first reference time, and determining that the proper amount of water has not supplied to the ice tray in case that the sensed time differs from the first reference time.

In accordance with a further aspect, the present invention provides a water supply control method for an ice maker comprising the steps of: (a) supplying water to an ice tray for a predetermined time; (b) determining whether or not a proper amount of water has been supplied to the ice tray after the predetermined time has elapsed; and (c) performing additional water supply for a predetermined additional water supply time, in case that it is determined that less than the proper amount of water has been supplied to the ice tray.

The additional water supply may be performed using an additional water supply table contained in predetermined water supply data.

The step (c) may include the sub-steps of: (c-1) determining whether or not time taken to vary the temperature of the ice tray by a first temperature variation is smaller than a first reference time; (c-2) determining whether or not the time is smaller than a second reference time, in case that it is determined that the time is smaller than the first reference time; and (c-3) performing additional water supply for a time selected from predetermined additional water supply data, in case that it is determined that the time is not smaller than the second reference time.

The step (c) may further include the sub-step of (c-4) resetting the first predetermined time, in case that it is determined that the time is smaller than the second reference time.

The step (c) may include the stub-steps of: (c-1) determining whether or not time taken to vary the temperature of the ice tray by a first temperature variation is smaller than a predetermined first reference time; (c-2) performing additional water supply for a second predetermined time and then sensing time taken to vary the temperature of the ice tray by a predetermined second variation, in case that it is determined that the time taken to vary the temperature of the ice tray by the first temperature variation is not smaller than the first reference time; and (c-3) comparing the time taken to vary the temperature of the ice tray by the predetermined second variation to a third reference time, and performing additional water supply for an additional water supply time corresponding to the time taken to vary the temperature of the ice tray by the predetermined second variation in case that it is determined that the time taken to vary the temperature of the ice tray by the second variation is smaller than the third reference time and determining that the ice maker has failed in case that it is determined that the time taken to vary the temperature of the ice tray by the second variation is not smaller than the third reference time.

The water supply control method may further comprise the step of (d) lengthening the first predetermined time, in case that it is determined that the time taken to vary the temperature of the ice tray by the second variation is not smaller than the first reference time.

The step (b) may include the sub-steps of: (b-1) supplying water to the ice tray for a first predetermined time, and sensing variation in the temperature of the ice tray; (b-2) sensing time taken to vary the temperature of the ice tray by a first temperature variation; and (b-3) determining that the proper amount of water has been supplied to the ice tray in case that the sensed time is the same as a first reference time, and determining that the proper amount of water has not supplied to the ice tray in case that the sensed time differs from the first reference time.

In accordance with another aspect, the present invention provides a water supply control apparatus for an ice maker comprising: an ice tray; a water supply pipe for supplying water to the ice tray; a water supply valve installed at one side of the water supply pipe for controlling the water supply pipe to supply the water to the ice tray for a predetermined time; and a water supply control unit determining whether or not a proper amount of water has been supplied to the ice tray after the predetermined time has elapsed, and resetting the predetermined time, in case that it is determined that more than the proper amount of water has been supplied to the ice tray.

The water supply control unit may perform additional water supply for a predetermined additional water supply time, in case that it is determined that less than the proper amount of water has been supplied to the ice tray.

The water supply control unit may reset the predetermined time, in case that it is determined that less than the proper amount of water has been supplied to the ice tray.

In accordance with yet another aspect, the present invention provides a water supply control apparatus for an ice maker comprising: an ice tray; a water supply pipe for supplying water to the ice tray; a water supply valve installed at one side of the water supply pipe for controlling the water supply pipe to supply the water to the ice tray for a predetermined time; and a water supply control unit determining whether or not a proper amount of water has been supplied to the ice tray after the predetermined time has elapsed, and performing additional water supply for a predetermined additional water supply time, in case that it is determined that less than the proper amount of water has been supplied to the ice tray.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
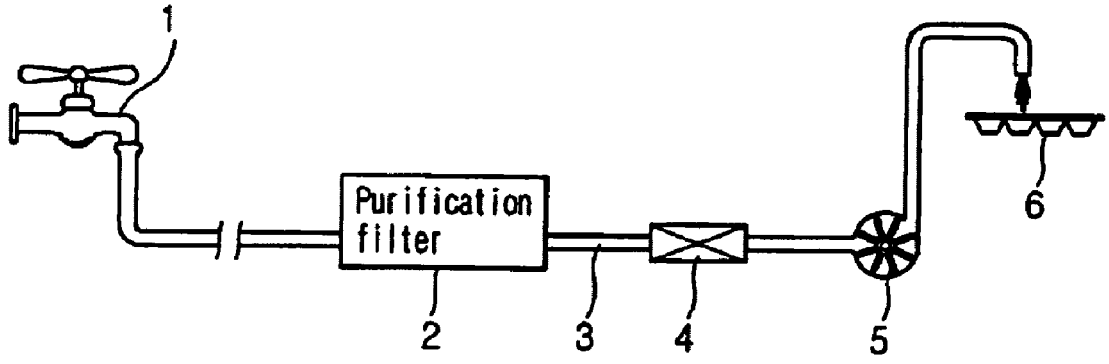
FIG. 1 (PRIOR ART)
FIG. 1 is a schematic view of a conventional water supply control apparatus for an ice maker.

Reference will now be made in detail to the embodiment of the present invention, an example of which is illustrated in the accompanying drawings, wherein like reference numerals refer to like elements throughout. The embodiments are described below to explain the present invention by referring to the figures.

Figure 2:
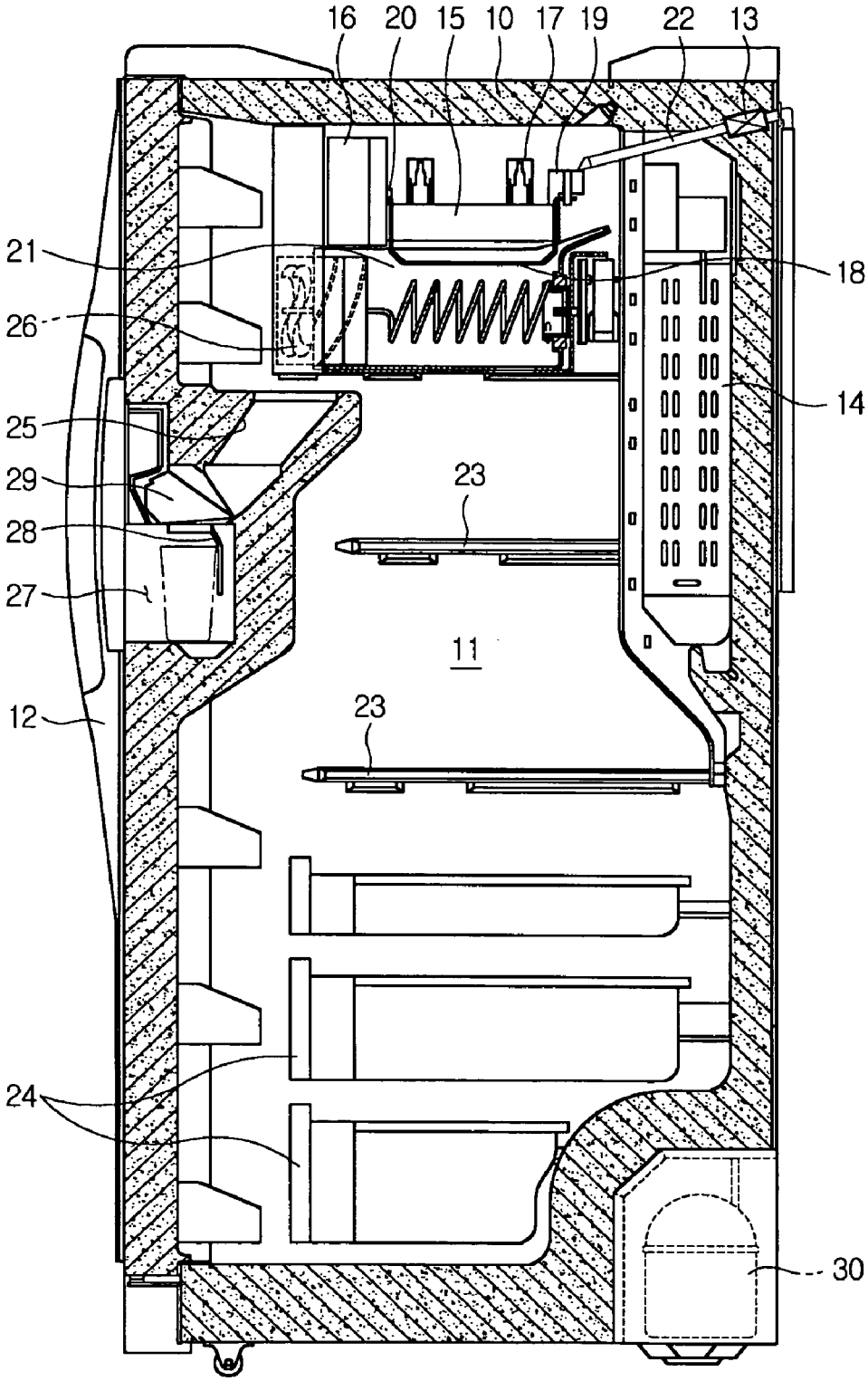
FIG. 2 is a longitudinal-sectional view of a refrigerator using a water supply control apparatus for an ice maker in accordance with one embodiment of the present invention.

As shown in FIG. 2, a refrigerator using a water supply control apparatus for an ice maker in accordance with one embodiment of the present invention comprises a main body 10, a freezing chamber 11 formed in the main body 10 in a longitudinal direction and provided with an opened front surface, and a door 12 installed at the front surface of the main body 10 for opening and closing the opened front surface of the freezing chamber 11. Here, the door 12 is hinged to one side of the front surface of the main body 10 so that the door 12 is rotated to open and close the opened front surface of the freezing chamber 11. An evaporator 14 for generating cool air is installed at a rear wall of the main body 10, and a compressor 30 is installed at a rear part of the lower portion of the main body 10.

An ice tray 15 for making ice cubes and a control box 16 combined with the ice tray 15 are attached to a designated position of an upper portion of the wall of the freezing chamber 11. Brackets 17, each provided with a hole for fixing the ice tray 15 and the control box 16 combined with the ice tray 15 to the wall of the freezing chamber 11, are installed on the rear surface of the ice tray 15.

One end of a full ice level sensing lever 18 for sensing the amount of ice cubes stacked in an ice storage container 21, which will be described later, is connected to the central portion of the control box 16, and the other end of the full ice level sensing lever 18 is inserted into a fixing hole formed through a separate stationary member. A water supply member 19 for sending the supplied water to ice-making cavities 40 (FIG. 3) is placed at a right side of the upper surface of the ice tray 15. A temperature sensor 20 is attached to a designated point of the external surface of the control box 16 combined with the ice tray 15, thus sensing variation in the temperature by the supplied water. Preferably, the temperature sensor 20 is installed such that a most part of a case of the temperature sensor 20 is lower than openings of the ice-making cavities 40.

The ice storage container 21 for storing the obtained ice cubes is placed under the ice tray 15, a water supply pipe 22, for supplying water from an external water source, is extended from the outside and installed above the ice tray 15, and a water supply valve 13 for controlling the amount of water flowing in the water supply pipe 22 is installed at a designated position in the water supply pipe 22. A plurality of racks 23 and a plurality of storage boxes 24 for storing frozen foods are provided in the freezing chamber 11.

A discharge pipe 25, which communicates with the inside of the freezing chamber 11 for guiding the discharge of the ice cubes, is installed in the door 12 so that the ice cubes are taken out of the ice tray 15 without opening the door 12, and an ice conveying device 26, which conveys the ice cubes from the ice tray 15 to the discharge pipe 25, is installed in the freezing chamber 11. An ice receiving indentation 27 for easily receiving the ice cubes discharged through the discharge pipe 25 is formed in the front surface of the door 12, and a switch 28 for opening and closing an exit of the discharge pipe 25 and operating the conveying device 26 in the freezing chamber 11 and a guide member 29 for preventing the discharged ice cubes from scattering are installed in the ice receiving indentation 27.

Figure 3:
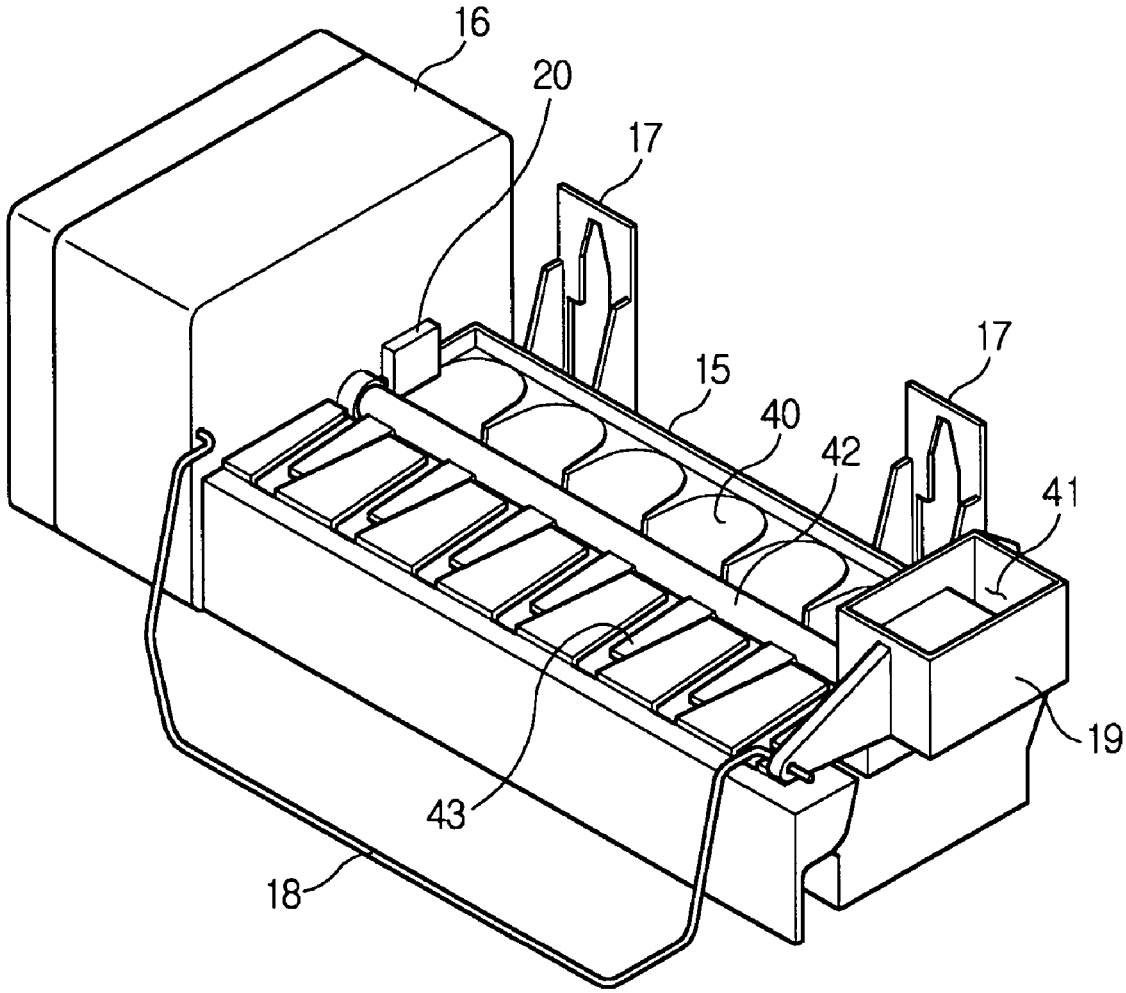
FIG. 3 is a perspective view of the water supply control apparatus in accordance with one embodiment of the present invention.

With reference to FIG. 3, the water supply control apparatus in accordance with one embodiment of the present invention comprises the ice tray 15 provided with a plurality of ice-making cavities 40. As shown in FIG. 3, a plurality of brackets 17, each provided with a fixing hole, through which the ice tray 15 is attached to the wall of the main body 10, are attached to the rear surface of the ice tray 15, and the water supply member 19 for receiving the water supplied from the water supply pipe 22 is placed at a right side of the upper surface of the ice tray 15. The water supply member 19 is provided with an opened upper surface and an inside portion of the bottom surface thereof being lower than the other portion of the bottom surface, thereby stably receiving water supplied from the water supply pipe 22. A water supply hole 41 for supplying water to the ice-making cavities 40 formed in the ice tray 15 is formed through the bottom of the water supply hole 19. The water supply hole 41 is connected to the rightmost ice-making cavity 40, thereby allowing the water supplied from the water supply member 19 to be supplied to the ice-making cavities 40 therethrough.

Walls, for easily separating the ice cubes from the ice-making cavities 40 after the ice cubes are produced, are formed between the neighboring ice-making cavities 40, and central areas of the walls formed between the neighboring ice-making cavities 40 are indented so that water supplied into the rightmost ice-making cavity 40 is supplied sequentially into the other ice-making cavities 40.

In FIG. 3, the control box 16 is combined with the left side of the ice tray 15, and an ice-separating motor 53 (FIG. 4) for achieving ice separation, a plurality of gears (not shown) connected to the ice-separating motor 53, a full ice level sensing unit 51 (FIG. 4) for sensing the amount of ice cubes stored in the ice storage container 21, and a controller 50 (FIG. 4) for controlling operations of various devices including the ice-separating motor 53 are placed in the control box 16. A through hole is formed through a central portion of one surface of the control box 16, and a shaft 42 of the ice-separating motor 53 is extended outwardly through the through hole. The extended end of the shaft 42 is rotatably connected to the lower part of the water supply member 19.

A plurality of ice-separating members 43 for achieving ice separation are installed on the shaft 42 of the ice-separating motor 53 at positions corresponding to the ice-making cavities 40. In an ice-separating mode, the controller 50 (FIG. 4) rotates the ice-separating motor 53 (FIG. 4) in a clockwise direction, and the ice-separating members 43 attached to the shaft 42 of the ice-separating motor 53 scoop up ice cubes produced in the ice-making cavities 40 and send the scooped-up ice cubes toward the front part of the ice maker. Then, the ice cubes are stored in the ice storage container 21 installed under the ice tray 15.

One end of the full ice level sensing lever 18, which is connected to the full ice level sensing unit 51 (FIG. 4) for sensing whether or not the ice cubes stored in the ice storage container 21 reach a full level, is connected to the control box 16, and the other end of the full ice level sensing lever 18 is inserted into the hole formed through the stationary member attached to the water supply member 19.

The temperature sensor 20, for sensing variation in the temperature due to the water supply, is attached to a contact portion between the control box 16 and the ice tray 15.

Figure 4:
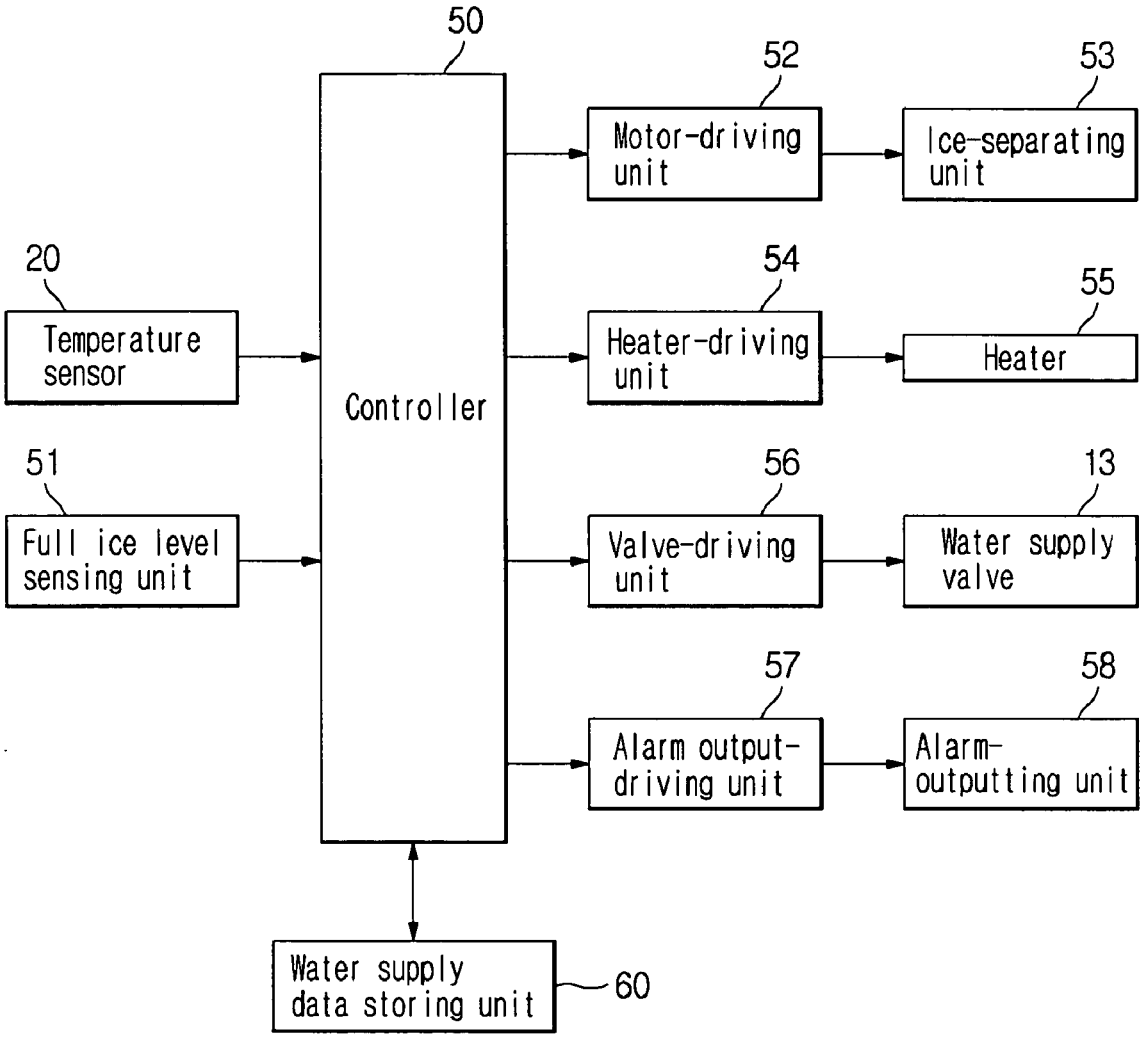
FIG. 4 is a block diagram of the water supply control apparatus in accordance with one embodiment of the present invention.

As shown in FIG. 4, the water supply control apparatus in accordance with one embodiment of the present invention comprises the temperature sensor 20 for sensing the temperature of the ice tray 15, the full ice level sensing unit 51 for sensing whether or not the ice cubes stored in the ice storage container 21 reach a full level, and a motor-driving unit 52 for driving the ice-separating motor 53 to rotate the ice-separating members 43.

The water supply control apparatus of the present invention further comprises a water supply data storing unit 60 for storing data for determining whether or not, based on time taken to vary a temperature sensed by the temperature sensor 20 by a predetermined variation, after the initial water supply, the water supply is terminated, or the additional water supply is started, or the initial water supply time is set again.

That is, the water supply data storing unit 60 stores a table containing data regarding the additional water supply amount or the reset of the initial water supply time corresponding to the time taken to vary the temperature sensed by the temperature sensor 20 by a predetermined variation, after the initial water supply is performed during the initial water supply time. Preferably, the above water supply data (for example, reference variation in the temperature, additional water supply amount, reset of initial water supply time, etc.) are set to proper values based on results obtained by experimentation.

For example, in case that the initial water supply time is 5 seconds, the reference variation in the temperature is 3° C., and the time taken to vary the temperature, sensed by the temperature sensor 20 after the initial water supply, by 3° C. is 3 seconds, it is determined that the supply of a proper amount of water is performed. The water supply data are set such that the water supply is terminated when the amount of water substantially supplied satisfies above requirements.

However, in case that the time taken to vary the temperature, sensed by the temperature sensor 20 after the initial water supply, by 3° C. is 2 seconds, it is determined the amount of initially supplied water is excessive and the water supply data are set such that the above initial water supply time is reduced to 4 seconds, and in case that the time taken to vary the temperature, sensed by the temperature sensor 20 after the initial water supply, by 3° C. is 1 second, it is determined the amount of initially supplied water is excessive and the water supply data are set such that the above initial water supply time is reduced to 3 seconds. The above set water supply data are applied to substantial water supply.

In case that the time taken to vary the temperature, sensed by the temperature sensor 20 after the initial water supply, by 3° C. exceeds the proper time, i.e., 3 seconds, and is 4 seconds, it is determined the amount of initially supplied water is smaller than the proper amount and the water supply data are set such that water is additionally supplied for 2 seconds, and in case that the time taken to vary the temperature, sensed by the temperature sensor 20 after the initial water supply by 3° C. is 5 seconds, it is determined the amount of initially supplied water is smaller than the proper amount and the water supply data are set such that water is additionally supplied for 3 seconds.

In case that the time taken to vary the temperature sensed by the temperature sensor 20 by 3° C. is more than 5 seconds, the water supply data are set such that water is additionally supplied for 3 seconds. Thereafter, in case that the time taken to vary the temperature sensed by the temperature sensor 20 by 3° C. is re-measured and the re-measured time is 2 seconds, the water supply data are set such that water is additionally supplied for 2 seconds and the initial water supply time is changed to 7 seconds, and in case that the re-measured time is 1 second, the water supply data are set such that water is additionally supplied for 1 second and the initial water supply time is changed to 6 seconds. On the other hand, in case that the re-measured time is more than the reference time, i.e., 3 seconds, it is determined that the ice maker has failed and the water supply data are set such that an alarm is outputted.

Although in the above embodiment of the present invention, in case that the time taken to vary the temperature, sensed by the temperature sensor 20 after the initial water supply, by 3° C. is more than 3 seconds, an additional water supply operation is performed or the initial water supply time at a next water supply mode is reset, it is possible to eliminate the additional water supply operation and to reset only the initial water supply time for the next water supply mode.

The water supply control apparatus of the present invention further comprises a heater-driving unit 54 for driving a heater 55, installed below the ice tray 15, for heating the ice tray 15 before an ice-separating mode, a valve-driving unit 56 for driving the water supply valve 13, and an alarm output-driving unit 57 for driving an alarm-outputting unit 58 for outputting an alarm when the water supply control apparatus fails.

The water supply control apparatus of the present invention further comprises the controller 50 for controlling components of the ice maker.

Figure 5A:
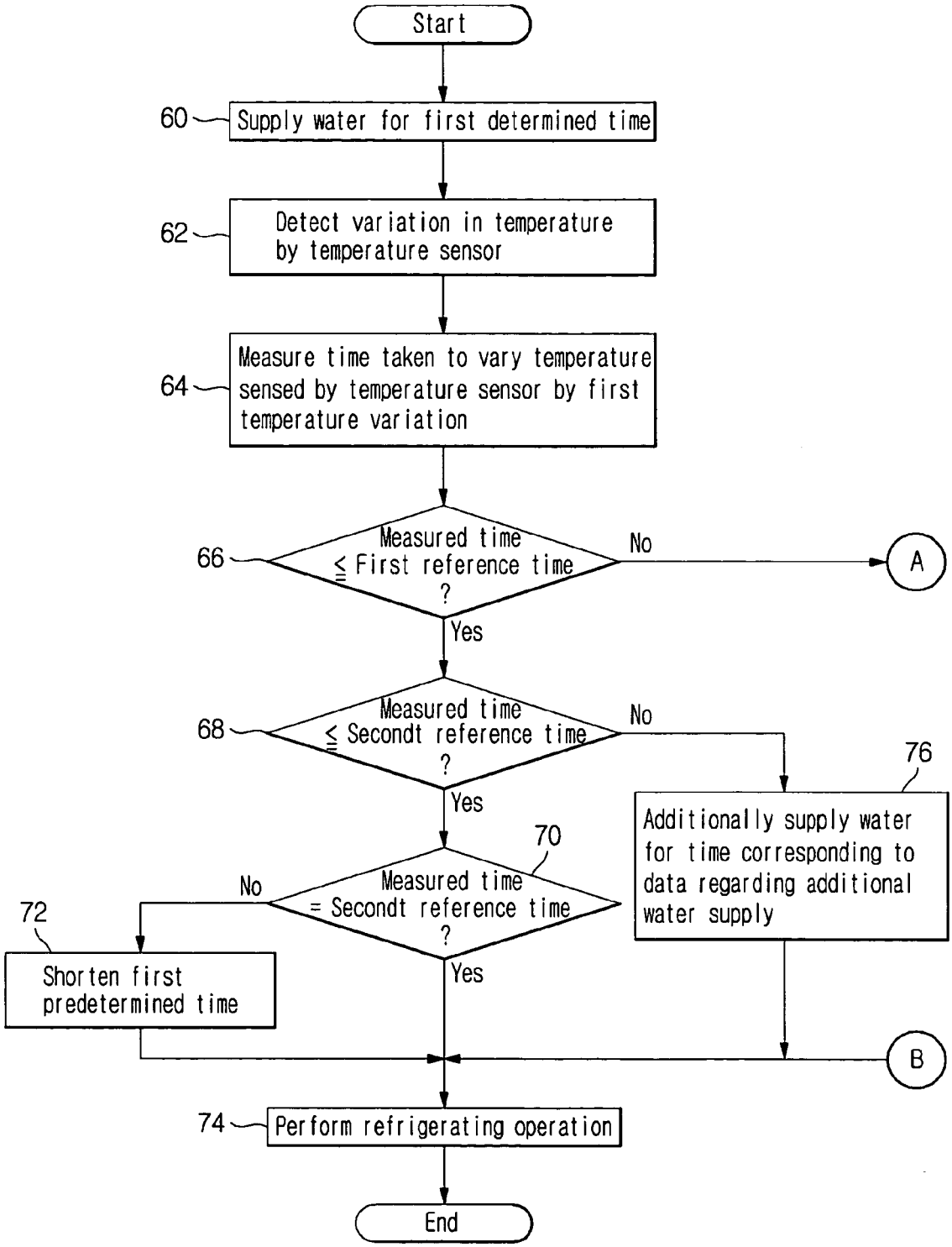
FIGS. 5A and 5B are flow charts illustrating a water supply control method for an ice maker in accordance with one embodiment of the present invention.
Figure 5B:
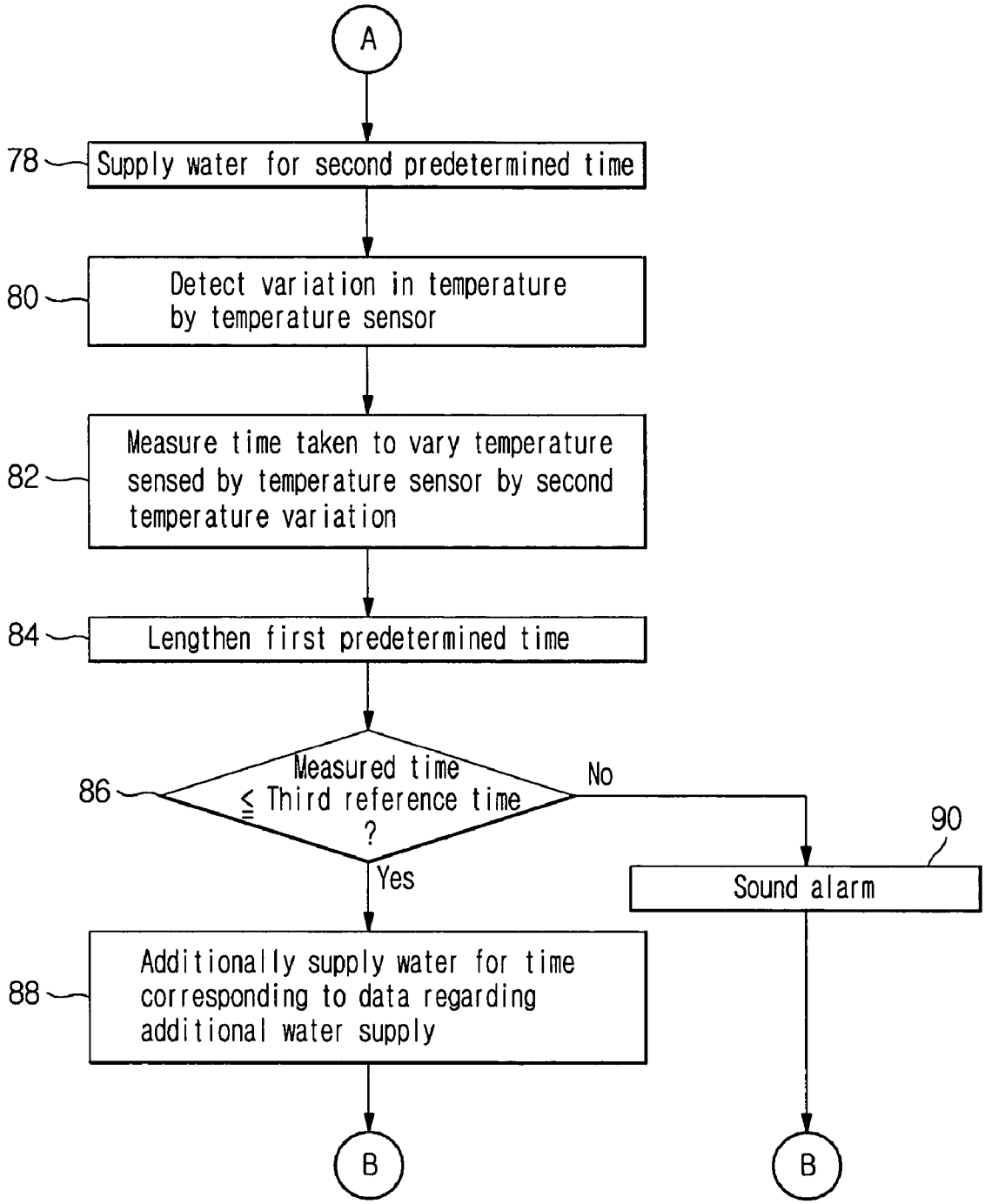

As shown in FIGS. 5A and 5B, in order to perform a water supply control process for an ice maker in accordance with one embodiment of the present invention, the controller 50 supplies water to the water supply control apparatus for a first predetermined time, which is stored in the water supply data storing unit 60 (S60). Here, the first predetermined time is an initial water supply time.

After the initial water supply is performed for the first predetermined time, the temperature sensor 20 senses variation in the temperature and transmits the sensed variation to the controller 50 (S62). The controller 50 measures time taken to vary the temperature sensed by the temperature sensor 20 by a first temperature variation stored in the water supply data storing unit 60 (S64). The first temperature variation is a reference temperature variation, and is set in consideration of a temperature variation when a proper amount of water is supplied to the ice tray 15.

The measurement of the time taken to vary the temperature sensed by the temperature sensor 20 by the first temperature variation serves to determine the initial water supply amount. That is, in case that water from a water supply source having a lower water pressure is supplied to the ice-maker, since the water supply amount for the same water supply time is small, the time taken to vary the temperature sensed by the temperature sensor 20 by the first temperature variation is long, and in case that water from a water supply source having a high water pressure is supplied to the ice-maker, since the water supply amount for the same water supply time is large, the time taken to vary the temperature sensed by the temperature sensor 20 by the first temperature variation is short.

After the time taken to vary the temperature, sensed by the temperature sensor 20, by the first temperature variation is measured, the controller 50 determines whether or not the measured time is smaller than a first reference time stored in the water supply data storing unit 60 (S66). The first reference time serves as a reference time for determining whether or not a proper amount of water has been supplied at the initial water supply mode, and preferably is set to a value slightly larger than the time taken to vary the temperature by the first temperature variation. In case that the measured time is smaller than the first reference time, the controller 50 determines whether or not the measured time is smaller than a second reference time stored in the water supply data storing unit 60 (S68). The second reference time is time taken to vary the temperature sensed by the temperature sensor 20 by the first temperature variation when a proper amount of water is supplied at the initial water supply mode, and is set to a value smaller than the first reference time. In case that the measured time is larger than the second reference time, water is additionally supplied for a time corresponding to data regarding the additional water supply stored in the water supply data storing unit 60 (S76).

However, in case that the measured time does not exceed the second reference time, the controller 50 determines whether or not the measured time is the same as the second reference time (S70). When the measured time is the same as the second reference time, the controller 50 determines that a proper amount of water has been supplied, and terminates the water supply mode, and when the measured time differs from the second reference time, the controller 50 shortens the first predetermined time (S72). After the additional water supply is performed or the first predetermined time is reset, a refrigerating mode is performed.

In case that the measured time at step S66 is not smaller than the first reference time, the controller 50 performs additional water supply during a second predetermined time stored in the water supply data storing unit 60 (S78). The second predetermined time is set to perform the additional water supply.

After the additional water supply is performed for the second predetermined time, the temperature sensor 20 senses variation in the temperature (S80), and then transmits the sensed variation to the controller 50. The controller 50 measures time to vary the temperature sensed by the temperature sensor 20 by a second temperature variation (S82), and resets the first predetermined time, stored in the water supply data storing unit 60, to an increased value (S84).

Thereafter, the controller 50 determines whether or not the measured time is smaller than a third reference time (S86). The third reference time is a designated value for determining whether or not the ice maker has failed after the additional water supply. In case that the measured time is larger than the third reference time, the controller 50 determines that the ice maker has failed.

In case that the measured time is smaller than the third reference time, the controller 50 performs additional water supply during an additional water supply time, corresponding to the measured time, stored in the water supply storing unit 60 (S88), and then performs the refrigerating mode (S74). In case that the measured time is larger than the third reference time, the controller 50 determines that the ice maker has failed and the alarm-outputting unit 58 sounds an alarm (S90).

In case that the time taken to vary the temperature, sensed by the temperature sensor 20, by the predetermined first temperature variation is smaller than the first reference time, the embodiment of the present invention may be constructed such that other steps are omitted but only a step of shortening the first predetermined time is performed. Thereafter, the refrigerating mode is performed.

As apparent from the above description, the present invention provides a water supply control apparatus and method for an ice maker, in which additional water supply, after initial water supply, is performed based on the initially supplied amount of water, or an initial water supply time is reset to adjust the amount of the initially supplied water, thereby supplying an accurate amount of water to an ice tray regardless of external stresses, such as variation of the water pressure.

Further, since the water supply time is divided into multiple stages, the water supply control method of the present invention controls the water supply according to the stages, thereby supplying an accurate amount of water.

Moreover, the water supply control apparatus of the present invention does not require an additional apparatus for detecting water pressure, thereby reducing production costs.

Although an embodiment of the invention has been shown and described, it would be appreciated by those skilled in the art that changes may be made in this embodiment without departing from the principles and spirit of the invention, the scope of which is defined in the claims and their equivalents.

What is claimed is:

1. A water supply control method for an ice maker comprising:

supplying water to an ice tray for a predetermined time;

determining whether or not a proper amount of water has been supplied to the ice tray after the predetermined time has elapsed; and automatically resetting the predetermined time based on predetermined water supply data, in case that it is determined that the proper amount of water has not supplied to the ice tray.

2. The water supply control method according to claim 1, wherein water is additionally supplied to the ice tray together with resetting the predetermined time based on the predetermined water supply data, in case that it is determined that less than the proper amount of water has been supplied to the ice tray.

3. The water supply control method according to claim 1, wherein determining whether or not a proper amount of water has been supplied to the ice tray after the predetermined time has elapsed includes:

supplying water to the ice tray for a first predetermined time, and sensing variation in the temperature of the ice tray;

sensing time taken to vary the temperature of the ice tray by a predetermined first temperature variation; and determining that the proper amount of water has been supplied to the ice tray in case that the sensed time is the same as a first reference time, and determining that the proper amount of water has not supplied to the ice tray in case that the sensed time differs from the first reference time.

4. A water supply control method for an ice maker comprising:

supplying water to an ice tray for a predetermined time;

determining whether or not a proper amount of water has been supplied to the ice tray after the predetermined time has elapsed; and performing additional water supply for a predetermined additional water supply time, in case that it is determined that less than the proper amount of water has been supplied to the ice tray, wherein performing additional water supply for a predetermined additional water supply time includes:

determining whether or not time taken to vary the temperature of the ice tray by a first temperature variation is smaller than a first reference time;

determining whether or not the time is smaller than a second reference time, in case that it is determined that the time is smaller than the first reference time; and performing additional water supply for a time selected from predetermined additional water supply data, in case that it is determined that the time is not smaller than the second reference time.

5. The water supply control method according to claim 4, wherein the additional water supply is performed using an additional water supply table contained in predetermined water supply data.

6. The water supply control method according to claim 4, wherein performing additional water supply for a predetermined additional water supply time further includes resetting the first predetermined time, in case that it is determined that the time is smaller than the second reference time.

7. A water supply control method for an ice maker comprising:

supplying water to an ice tray for a predetermined time;

determining whether or not a proper amount of water has been supplied to the ice tray after the predetermined time has elapsed; and performing additional water supply for a predetermined additional water supply time, in case that it is determined that less than the proper amount of water has been supplied to the ice tray, wherein performing additional water supply for a predetermined additional water supply time includes:

determining whether or not time taken to vary the temperature of the ice tray by a first temperature variation is smaller than a predetermined first reference time;

performing additional water supply for a second predetermined time and then sensing time taken to vary the temperature of the ice tray by a predetermined second variation, in case that it is determined that the time taken to vary the temperature of the ice tray by the first temperature variation is not smaller than the first reference time; and comparing the time taken to vary the temperature of the ice tray by the predetermined second variation to a third reference time, and performing additional water supply for an additional water supply time corresponding to the time taken to vary the temperature of the ice tray by the predetermined second variation in case that it is determined that the time taken to vary the temperature of the ice tray by the second variation is smaller than the third reference time and determining that the ice maker has failed in case that it is determined that the time taken to vary the temperature of the ice tray by the second variation is not smaller than the third reference time.

8. The water supply control method according to claim 7, further comprising lengthening the first predetermined time, in case that it is determined that the time taken to vary the temperature of the ice tray by the second variation is not smaller than the first reference time.

9. A water supply control method for an ice maker comprising:

supplying water to an ice tray for a predetermined time;

determining whether or not a proper amount of water has been supplied to the ice tray after the predetermined time has elapsed; and performing additional water supply for a predetermined additional water supply time, in case that it is determined that less than the proper amount of water has been supplied to the ice tray, wherein determining whether or not a proper amount of water has been supplied to the ice tray after the predetermined time has elapsed includes:

supplying water to the ice tray for a first predetermined time, and sensing variation in the temperature of the ice tray;

sensing time taken to vary the temperature of the ice tray by a first temperature variation; and determining that the proper amount of water has been supplied to the ice tray in case that the sensed time is the same as a first reference time, and determining that the proper amount of water has not supplied to the ice tray in case that the sensed time differs from the first reference time.

10. A water supply control apparatus for an ice maker comprising:

an ice tray;

a water supply pipe for supplying water to the ice tray;

a water supply valve installed at one side of the water supply pipe for controlling the water supply pipe to supply the water to the ice tray for a predetermined time; and a water supply control unit determining whether or not a proper amount of water has been supplied to the ice tray after the predetermined time has elapsed, and automatically resetting the predetermined time, in case that it is determined that more than the proper amount of water has been supplied to the ice tray.

11. The water supply control apparatus according to claim 10, wherein the water supply control unit performs additional water supply for a predetermined additional water supply time, in case that it is determined that less than the proper amount of water has been supplied to the ice tray.

12. The water supply control apparatus according to claim 10, wherein the water supply control unit resets the predetermined time, in case that it is determined that less than the proper amount of water has been supplied to the ice tray.

13. A water supply control apparatus for an ice maker comprising:

an ice tray;

a water supply pipe for supplying water to the ice tray;

a water supply valve installed at one side of the water supply pipe for controlling the water supply pipe to supply the water to the ice tray for a predetermined time; and a water supply control unit determining whether or not a proper amount of water has been supplied to the ice tray after the predetermined time has elapsed, and automatically performing additional water supply for a predetermined additional water supply time, in case that it is determined that less than the proper amount of water has been supplied to the ice tray.

* * * * *